US012016383B2

(12) United States Patent
Garrett

(10) Patent No.: US 12,016,383 B2
(45) Date of Patent: Jun. 25, 2024

(54) INDIVIDUALLY PACKAGED POD

(71) Applicant: Reid Spencer Garrett, Los Angeles, CA (US)

(72) Inventor: Reid Spencer Garrett, Los Angeles, CA (US)

( * ) Notice: Subject to any disclaimer, the term of this patent is extended or adjusted under 35 U.S.C. 154(b) by 530 days.

(21) Appl. No.: 16/868,862

(22) Filed: May 7, 2020

(65) Prior Publication Data

US 2021/0345666 A1 Nov. 11, 2021

(51) Int. Cl.

| | |
|---|---|
| ***A24D 1/14*** | (2006.01) |
| ***A24F 40/42*** | (2020.01) |
| *A24F 1/00* | (2006.01) |
| *A24F 9/00* | (2006.01) |

(52) U.S. Cl.

CPC ..... *A24F 40/42* (2020.01); *A24D 1/14* (2013.01); *A24F 1/00* (2013.01); *A24F 9/00* (2013.01)

(58) Field of Classification Search

CPC ..... A24D 1/14

See application file for complete search history.

(56) References Cited

U.S. PATENT DOCUMENTS

| | | | | |
|---|---|---|---|---|
| 1,614,903 | A * | 1/1927 | Shakal | A24F 1/30 131/215.1 |
| 5,996,826 | A * | 12/1999 | Williams | B65D 9/10 217/3 BC |
| 8,490,630 | B2 * | 7/2013 | Boutros | A24F 1/30 131/226 |
| 9,433,241 | B2 * | 9/2016 | Jalloul | A24F 5/04 |
| 9,820,512 | B2 * | 11/2017 | Mironov | A24F 40/42 |
| 11,111,062 | B2 * | 9/2021 | Herlin | B65D 25/08 |
| 11,589,614 | B2 * | 2/2023 | Kaufman | A24F 40/465 |
| 2011/0083674 | A1 * | 4/2011 | Karpinsky | A24F 13/16 131/175 |
| 2020/0128880 | A1 * | 4/2020 | Gage | A24B 15/167 |

FOREIGN PATENT DOCUMENTS

WO WO-2020142824 A1 * 7/2020

OTHER PUBLICATIONS

How To-Press Metal Mesh Grills, YouTube, Alphabet Inc., posted by user jat4011, https://www.youtube.com/watch?v=XUXpGjQjh3o (Year: 2016).*

* cited by examiner

*Primary Examiner* — Russell E Sparks

(74) *Attorney, Agent, or Firm* — Georgiy L. Khayet

(57) ABSTRACT

Provided is an individually packaged pod for receptacles of smoking pipes and other smoking devices. The individually packaged pod may have a product, such as herbs or herb mixtures, placed inside the individually packaged pod. The individually packaged pod may include an insert, a ring, and a cover. The insert may be made of a mesh having a convex three-dimensional shape to form a receptacle for receiving the product. The ring may be connected to the insert and configured to maintain the convex three-dimensional shape of the insert. The cover may be made of a sheet material and attached to the ring to enclose the product inside the insert. Upon placing the individually packaged pod into a receptacle of a pipe, a user may ignite the cover and the product inside the individually packaged pod. Burning of the product creates smoke to be inhaled by the user.

20 Claims, 10 Drawing Sheets

3/10

INDIVIDUALLY PACKAGED POD

TECHNICAL FIELD

The present disclosure relates generally to individually packaged pods and, more particularly, to individually packaged pods for receptacles of smoking pipes and other smoking devices.

BACKGROUND

People who use smoking pipes typically carry a separate container with herbs of their choice. In order to use a smoking pipe, a user needs to take the herbs out of the container, place the herbs into the receptacle of the smoking pipe, and ignite the herbs placed into the receptacle. All of these steps require considerable effort and time. Furthermore, once finished, the user needs to clear the contents of the receptacle by taking out and disposing of the ash. Moreover, in some smoking pipes, the ash may depart the receptacle and clog smoke channels of the pipes. To make things even worse, the ash may travel, via the smoke channel, and enter the respiratory system of the smoker. Thus, smoking a conventional pipe may entail a number of issues for the user.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

According to one example embodiment, an individually packaged pod is provided. The individually packaged pod may include an insert, a ring, and a cover. The insert may be made of a mesh. The insert may have a convex three-dimensional shape to form a receptacle for receiving a product. The insert may have an outer edge. The ring may be connected to the outer edge of the insert. The ring may be configured to maintain the convex three-dimensional shape of the insert. The cover may be made of a sheet material. The cover may have a peripheral edge and be configured to be attached to the ring by the peripheral edge to enclose the product inside the insert.

According to another example embodiment, a method for providing an individually packaged pod is provided. The method may commence with providing an insert made of a mesh. The insert may have an outer edge. The insert may have a convex three-dimensional shape to form a receptacle for receiving a product. The method may further include providing a ring connected to the outer edge of the insert. The ring may be configured to maintain the convex three-dimensional shape of the insert. The method may further include providing a cover made of a sheet material. The cover may have a peripheral edge. The cover may be configured to be attached to the ring by the peripheral edge to enclose the product inside the insert.

Additional objects, advantages, and novel features will be set forth in part in the Detailed Description section of this disclosure, which follows, and in part will become apparent to those skilled in the art upon examination of this specification and the accompanying drawings or may be learned by production or operation of the example embodiments. The objects and advantages of the concepts may be realized and attained by means of the methodologies, instrumentalities, and combinations particularly pointed out in the appended claims.

BRIEF DESCRIPTION OF THE DRAWINGS

Embodiments are illustrated by way of example and not limitation in the figures of the accompanying drawings, in which like references indicate similar elements and in which.

DETAILED DESCRIPTION

The following detailed description includes references to the accompanying drawings, which form a part of the detailed description. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and electrical changes can be made without departing from the scope of what is claimed. The following detailed description is, therefore, not to be taken in a limiting sense, and the scope is defined by the appended claims and their equivalents.

The present disclosure provides an individually packaged pod (also referred to herein as a pod) designed for use with smoking pipes and other smoking devices. The pod may have an insert made of a mesh, a ring connected to an outer edge of the insert to maintain the shape of the insert, and a cover attached to the ring to cover the inner space of the insert. The insert may have a convex three-dimensional shape to form a receptacle for receiving a product, such as tobacco, marijuana, or an herb mixture of user's choice. The shape of the insert may be designed for placement into the receptacle of a smoking pipe. The mesh may be made of metal wires woven with each other. The mesh may be press-formed into a convex three-dimensional shape. The cover may be made of a sheet material, such as paper, and designed for keeping the product in the insert. The cover may also serve as a label and may have printed information about the contents of the pod.

To smoke, the user may place an individually packaged pod into the receptacle of the smoking pipe and ignite the cover with a lighter. Once ignited, the cover can burn through the product located inside and also ignite the product. Alternatively, the product can be ignited directly by the user. Once finished, the user may remove and dispose of the pod and ash.

Individually packaged pods can allow easy use at home or on the go by eliminating the need to carry a container with herbs and for removing the herbs from the container and them into the receptacle. The individually packaged pod can also solve the issue of having to dispose of the ash accumulated in the receptacle. Thus, the user does not need to clean out resin build-up elements or deal with dirty smelly water, clogged utensils, or ash entering the mouth, as is the case with conventional smoking pipes.

Figures 1A, 1B, 1C:
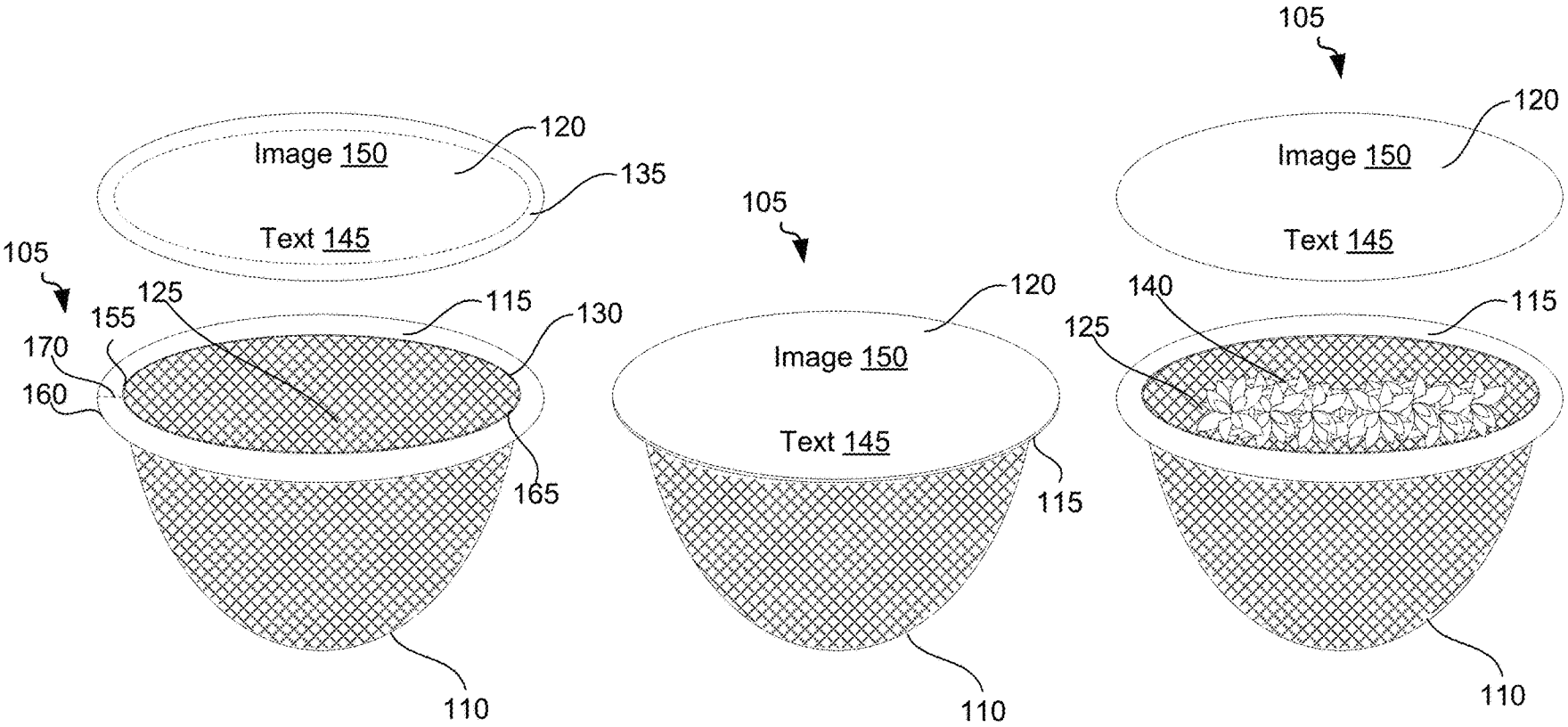
FIGS. 1A-1C show an individually packaged pod, according to an example embodiment.

Referring now to the drawings, FIGS. 1A-1C show an individually packaged pod, according to an example embodiment. FIG. 1A is a front perspective expanded view of the individually packaged pod shown as pod 105. The pod 105 may have an insert 110, a ring 115, and a cover 120. The insert 110 may be made of a mesh. The insert 110 may have a convex three-dimensional shape to form a receptacle 125 for receiving a product. In an example embodiment, the insert 110 may be press-formed to have the convex three-dimensional shape. The convex three-dimensional shape of the insert 110 may be selected to fit a receptacle of a smoking pipe or any other smoking device. In an example embodiment, the convex three-dimensional shape of the insert 110 may include a hemisphere, a hemispheroid, a rectangular three-dimensional shape (e.g., a cubic shape, a parallelepiped shape), a conical three-dimensional shape, and so forth.

The insert 110 may have an outer edge 130. The ring 115 may be connected to the outer edge 130 of the insert 110 and be configured to maintain the convex three-dimensional shape of the insert 110. Specifically, the ring 115 has an inner diameter 155 and an outer diameter 160. The ring 115 has a width 170 that is the difference between the outer diameter 160 and the inner diameter 155. The ring 115 may have a groove 165 passing along the inner diameter 155. The outer edge 130 of the insert 110 may be pressed into the groove 165 and retained inside the ring 115. In an example embodiment, the outer edge 130 of the insert 110 may be placed inside the ring 115 by roll-forming a sheet of material (e.g., a metal) to bend the sheet of material and placing the outer edge 130 of the insert 110 between two edges of the sheet of material, i.e., into the groove 165. Therefore, the sheet of material forms the ring 115 crimped or pressed over the outer edge 130 of the insert 110.

The cover 120 may be made of a sheet material. The cover 120 may have a peripheral edge 135. The cover 120 may be configured to be attached to the ring 115 by the peripheral edge 135 to enclose the product inside the insert 110. FIG. 1A shows the cover 120 before the cover 120 is attached to the ring 115.

FIG. 1B is a front perspective view of the pod 105 with the cover 120 attached to the ring 115. The ring 115 may be made of a metal or any other material suitable for maintaining the shape of the insert.

FIG. 1C is a front perspective expanded view of the pod 105 with a product 140 placed in the receptacle 125 inside the insert 110. The product 140 may include one or more of the following: a medical product, medical plant, marijuana plant, tobacco plant, plant mixture, burnable substance, and so forth. Upon placing the product 140 into the insert 110, the cover 120 may be attached, e.g., by gluing, to the ring 115. Upon attaching the cover 120 to the ring 115 of the insert 110, the pod 105 may be ready for use.

The amount of the product 140 in the pod 105 may be selected based on specific needs of customers. In an example embodiment, the weight of the product 140 may be 0.25 grams per each pod 105.

In an example embodiment, the sheet material of the cover 120 is paper. The paper may be smoking paper, rice paper, hemp paper, flax paper, sisal paper, esparto paper, and so forth. The cover 120 may serve as a label of the pod 105. Specifically, text 145 or an image 150 may be printed on the cover 120. The text 145 may describe the content of the pod 105 (for example, may state the name and weight of the product 140) and further include directions for use of the pod 105. The image 150 may include a logo, image of the product 140, and so forth. The ink used for printing on the cover 120 may be non-toxic, which, such that when burnt, does not cause any harm to humans.

In an example embodiment, the information printed on the cover 120 may be configured to be read by a reader of a machine (e.g., a vaporizer) or any electronic device. Specifically, the pod 105 may be placed into the machine or placed in front of a camera of the electronic device. The machine and the electronic device may have the reader configured to read the information printed on the cover. Based on the information read from the cover 120 by the reader, the machine or the electronic device may obtain information regarding the contents of an herb/herb mixture inside the pod 105, directions for processing the pod by the machine, and any other information. Based on the information obtained from the cover, the machine may select a temperature profile and/or other parameters for processing the pod and may subject the herb/herb mixture of the pod to a vaporization process according to the selected temperature profile and/or parameters. The information printed on the cover 120 may be presented in a form of a code, such as a barcode, a quick response code, and so forth. The reader of the machine and the electronic device can be configured to read codes.

Figure 2B:
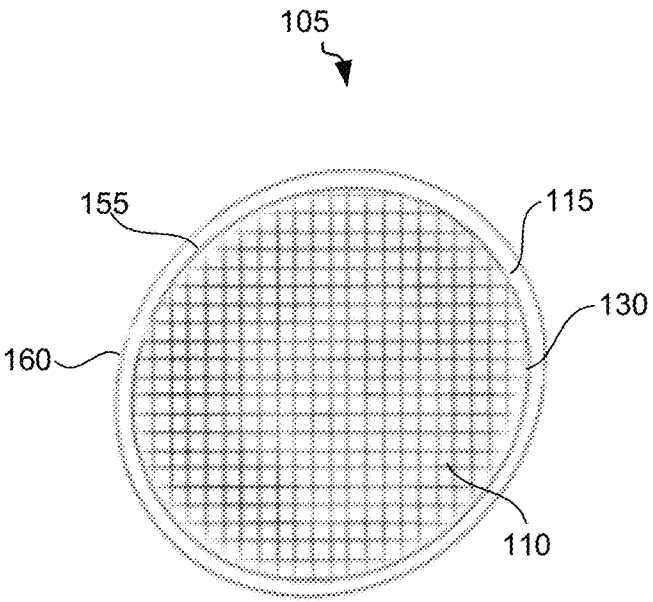
FIG. 2B is a bottom view of a pod, according to an example embodiment.
Figure 2C:
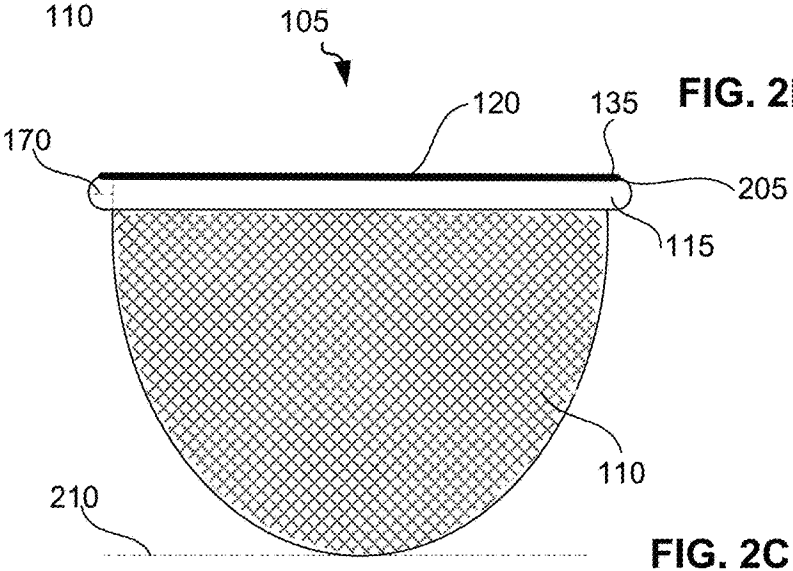
FIG. 2C is a side view of a pod, according to an example embodiment.
Figure 2A:
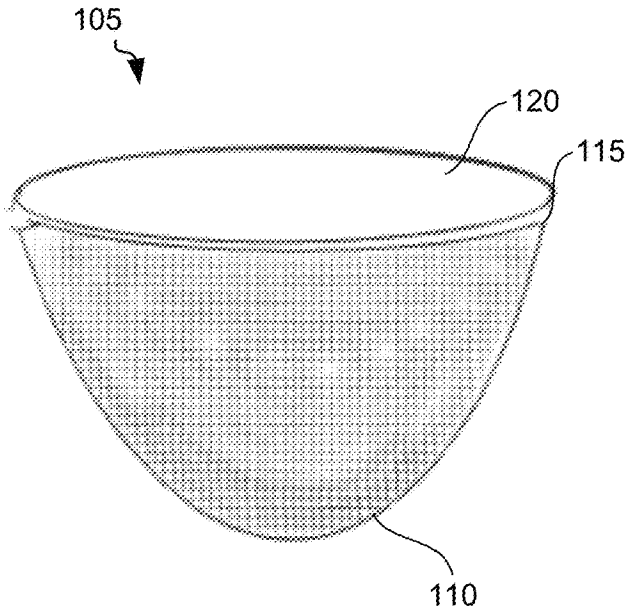
FIG. 2A is a front perspective view of a pod, according to an example embodiment.

FIG. 2A is a front perspective view of the pod 105, according to an example embodiment. FIG. 2B is a bottom view of the pod 105, according to an example embodiment. As shown in FIG. 2B, the inner diameter 155 of the ring 115 may be substantially equal to a diameter of the outer edge 130 of the insert 110. The outer diameter 160 of the ring 115 may be greater than the diameter of the outer edge 130 of the insert 110. The ring 115 extending beyond the diameter of the outer edge 130 of the insert 110 may be configured to rest on the wall of the receptacle of the smoking pipe (as shown in detail in FIG. 6).

FIG. 2C shows a side view of the pod, according to an example embodiment. The width 170 of the ring 115 may extend along a horizontal axis 210. In further example embodiments, the width 170 of the ring 115 may extend at a predetermined angle upwards or downwards with respect to the horizontal axis 210.

The ring 115 may have a rim 205. The peripheral edge 135 of the cover 120 may be attached to the rim 205. The attachment may be performed by applying a glue on the rim 205 and/or the peripheral edge 135 of the cover 120, placing the cover 120 onto the rim 205 of the ring 115 to face the peripheral edge 135 of the cover 120 with the ring 115, and pressing the cover 120 onto the ring 115.

In an example embodiment, the diameter of the cover may be equal to the diameter of the rim 205 of the ring 115. In a further example embodiment, the diameter of the cover may be equal to the outer diameter 160 of the ring 115.

Figure 3:
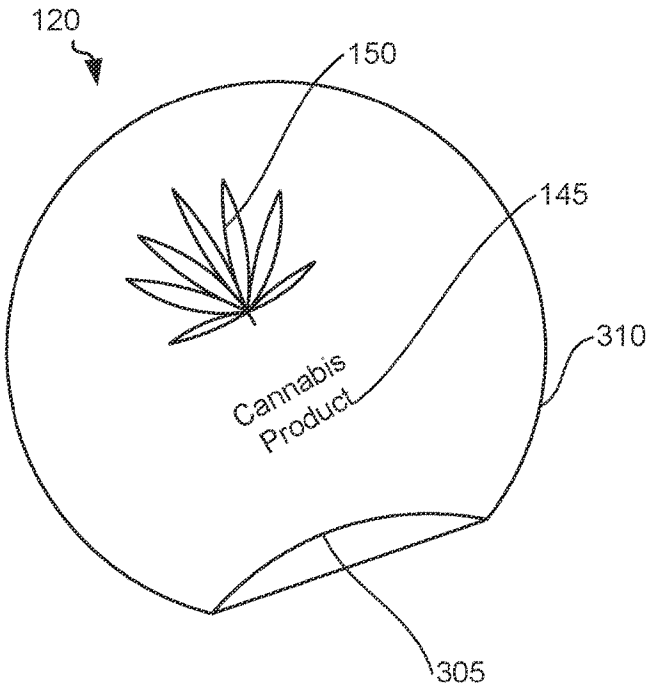
FIG. 3 is a general view of a cover, according to an example embodiment.

FIG. 3 is a general view of the cover 120, according to an example embodiment. The cover 120 may be made of a sheet material, such as paper, and may have a circular shape. The material of the cover 120 may emit no harmful particles when burned. This allows the user to ignite the product inside the pod 105 by igniting the cover 120 to make the cover 120 burn through and ignite the product. Burning the cover 120 may eliminate unnecessary waste.

The cover 120 may serve as a label. Any information, such as contents of the pod, logo, image, and so forth, can be printed according to needs of a customer ordering pods for subsequent resale.

In an example embodiment, the cover 120 may have a projection 305. The projection 305 may include a portion of the sheet material that extends beyond an outer diameter 310 of the cover 120. The projection 305 can be configured to be grasped to facilitate removal of the cover 120 from the pod 105. Specifically, the projection 305 may be designed to be grasped and pulled by a user upon opening the pod 105.

For example, the user may not want to burn the cover 120 through and rather manually ignite the product placed under the cover 120. In a further example embodiment, the user may remove the cover 120 from the pod prior to placing the pod into a vaporizer. The ignition of the product may be performed inside the vaporizer.

The pod 105 may be distributed to customers by applying different distribution models. In an example embodiment, pre-formed pods and pre-printed labels (i.e., covers) can be provided to customers. The labels may contain the strain and content information of the pod. The customers may fill the pre-formed pods with a product (for example, at a dispensary unit). The product may be received from any sources, such as grown by the customers or bought from third parties. Upon filling the pod with the product, the customers may close the insert of the pod with the label. In an example embodiment, the label may have a pre-deposited glue layer along the outer edge on one of the surfaces of the label. The label may be placed onto the ring of the pod such that the pre-deposited glue layer joins the ring. Upon placing the label onto the insert, the label may be attached to the insert, thereby creating a closed pod with the product inside the pod. Additionally, all tools necessary to fill pods may be additionally provided to the dispensary unit of the customers.

In a further example embodiment, the pods may be distributed based on a partnership model according to which the pods and/or the product can be provided to farms. The farms may pre-package and sell pods including license branded labels directly to dispensaries.

In a further example embodiment, the content of pods may be owned and controlled by a manufacturer of the pods. The pods may be sold under the name of a consumer-facing brand with ownership of strains. This model may allow for continued innovation for ancillary products for the pods.

FIGS. 4A-4D show various embodiments of a mesh used for manufacturing the insert of the pod. The structure of the mesh allows for air to flow through the mesh. The mesh may be made of a plurality of wires interconnected with each other, as shown by meshes 405, 410, and 415 in FIGS. 4A, 4B, and 4C, respectively. Specifically, the wires may be woven with each other, soldered to each other, and in any other way connected with each other. The wires may be woven orthogonally with each other or by using any other pattern of weaving.

In an example embodiment, each of the insert, the ring, the cover, and the pod itself may be recyclable. A user who bought and used the pod may bring the pod to a predetermined collection point and return the pod for recycling.

In an example embodiment, the mesh can be made of metal. The metal may be selected from metals that do not expose particles harmful to a user upon heating. The metal may be a medical grade metal and/or a food-grade metal. The term "medical-grade" can be defined as a property of the material according to which the intended contact of the metal with a potential human user is safe for the user. The metal may include aluminum, stainless steel, titanium, a metal alloy, and so forth. The term "food-grade" includes a property of the material according to which the intended contact of the metal with food does not make the food harmful to the user.

Figure 4A:
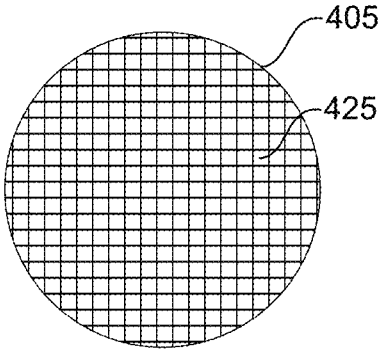
FIGS. 4A-4D show a mesh used for manufacturing an insert of a pod, according to example embodiments.
Figure 4B:
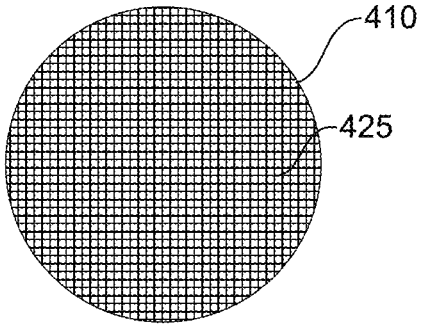
Figure 4C:
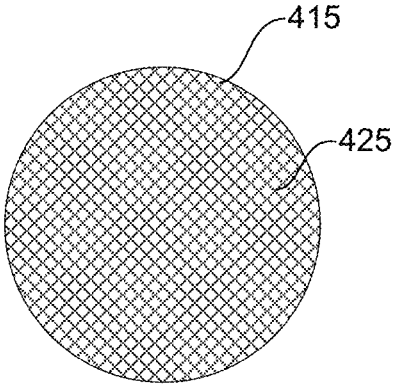
Figure 4D:
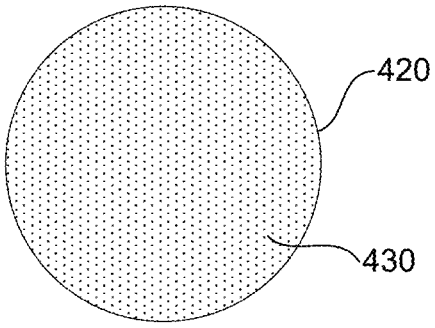

As shown in FIG. 4A, the mesh 420 may be made of a perforated sheet. The perforated sheet can be made of metal.

The size of openings 425 created between wires of the meshes 405, 410, and 415, and the size of openings 430 created by perforation in mesh 420 may vary and may be selected to be small enough for preventing the product from penetrating the mesh. The mesh may have a tighter or looser weave. A different size of the openings 425 and 430 may be selected for different types of the product. Additionally, the product inside the pod may be grounded in order for the parts of the product to have a predetermined size that is greater than the size of the openings 425 or 430.

Figure 5B:
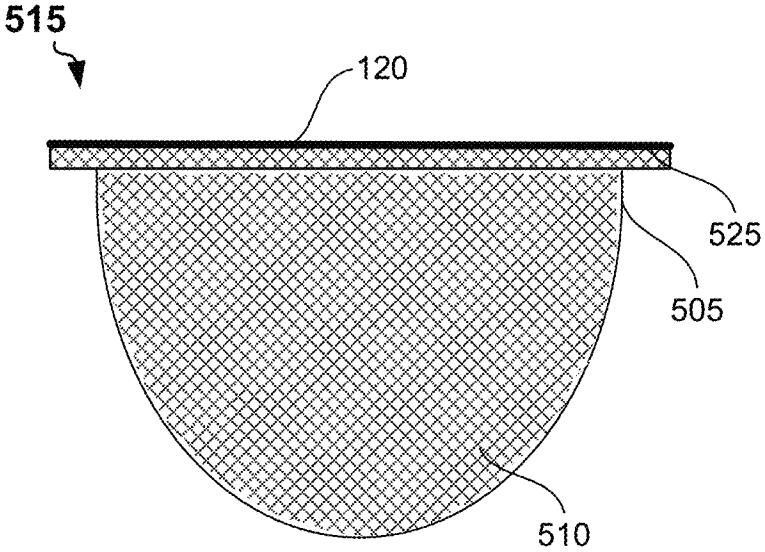
FIGS. 5A and 5B are schematic diagrams showing a pod having an insert and a ring made as a single element, according to an example embodiment.
Figure 5A:
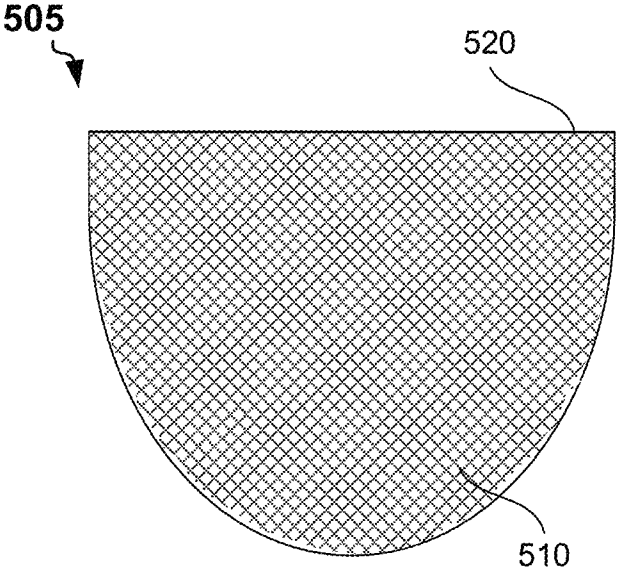

FIGS. 5A and 5B are schematic diagrams showing a pod with an insert and a ring made of a mesh as a single element, according to an example embodiment. FIG. 5A shows an insert 505 made of a mesh 510. The insert 505 may be used to make a pod that does not have a separate ring, i.e., does not have a ring as a separate element attached to the insert 505. Specifically, FIG. 5B shows a pod 515 with a ring 525 made of the mesh 510. A user may take the mesh 510 shown in FIG. 5A and shape/form the mesh 510 into the mesh 510 with a convex three-dimensional shape as needed, e.g., for fitting a receptacle of a smoking pipe. Upon shaping/forming the mesh 510, the user may roll/bend an outer edge 520 (shown in FIG. 5A) of the mesh 510 and then crimp the outer edge 520 to form a ring 525 (as shown in FIG. 5B). Therefore, both the insert 505 and the ring 525 of the pod 515 can be integrated into a single element of the mesh 510. The mesh 510 and the ring 525 of the pod 515 can be shaped/formed according to sizes and shapes of receptacles of smoking pipes. In an example embodiment, the pod 515 having the insert 505 and the ring 525 made of the mesh 510 can be produced by a manufacture of the pod 515. Additionally, a cover 120 can be attached to the ring 525 of the pod 515.

Figure 6:
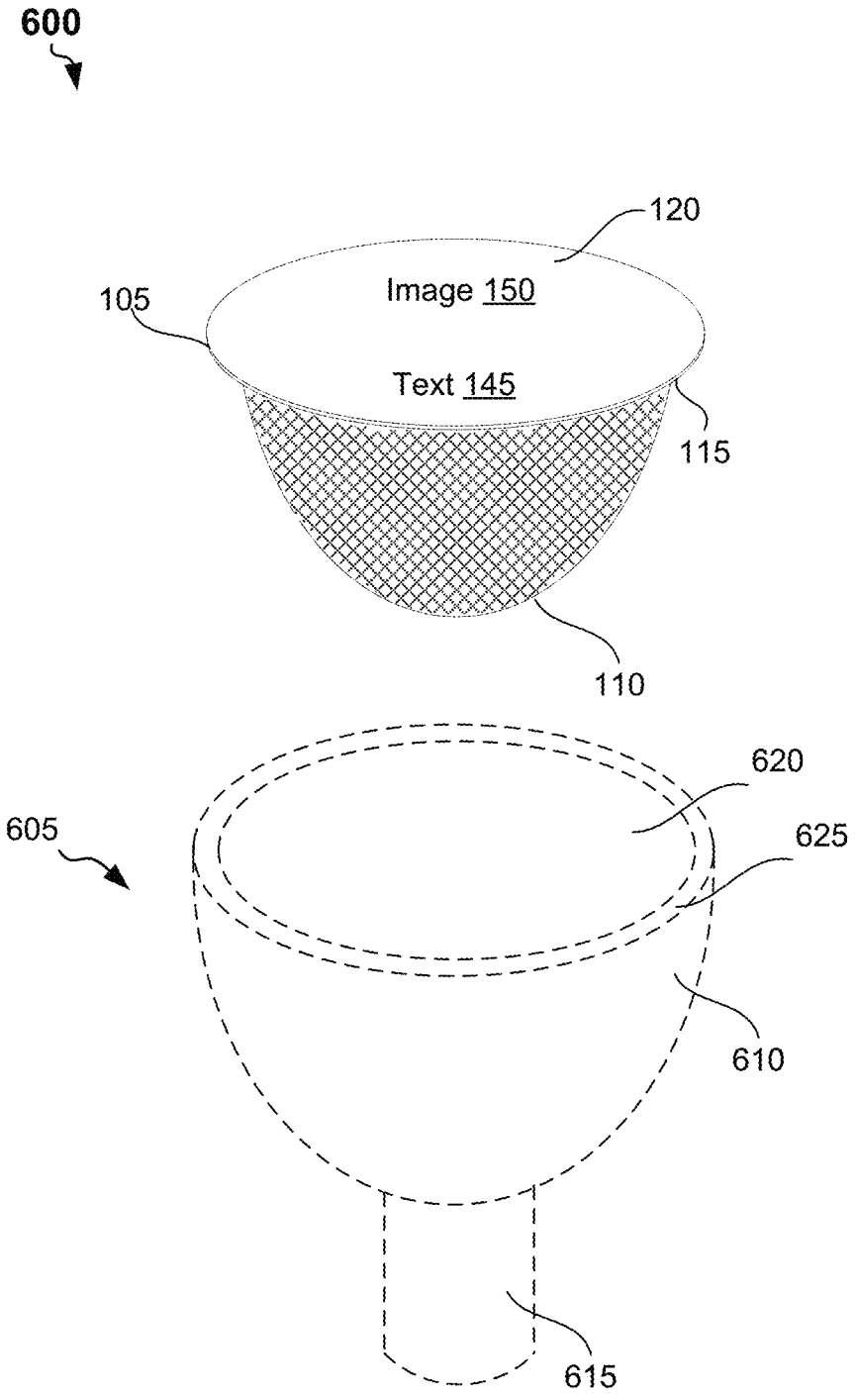
FIG. 6 is schematic diagram showing placing a pod into a receptacle of a smoking pipe, according to an example embodiment.

FIG. 6 is schematic diagram 600 showing placing the pod 105 into the receptacle of the smoking pipe, according to an example embodiment. A receptacle 605 may have a chamber 610 and a leg 615. The leg 615 may be configured to be inserted into the stem (not shown) of the smoking pipe. The pod 105 may be configured to be inserted into the chamber 610 of the receptacle 605. Specifically, the shape of the insert 110 of the pod 105 may be substantially the same as or similar to the shape of a cavity 620 of the chamber 610. Upon placing the pod 105 into the receptacle 605, the ring 115 of the pod 105 may rest on a wall 625 of the chamber 610.

Upon placing the pod 105 into the receptacle 605, a user may ignite the cover 120, e.g., with a lighter. The cover 120 may burn through and, while burning, cause the ignition of the product inside the pod 105. Furthermore, the user may ignite the product inside the pod 105 after the cover 120 is burned. Burning of the product creates smoke for inhaling by the user.

The size of the pod 105, including the diameter of the ring 115 and the width and height of the insert 110, may be selected to fit different types and sizes of receptacles of the smoking pipe. The pod 105 may be also configured as a drop-in insert for dry flower vaporizing devices. The shape of the insert of the pod 105 and the amount of the product held in the pod 105 may vary depending on the size of a chamber of the smoking pipe or vaporizing device for which the pod 105 is created. In particular, the width of the ring, a type of mesh used in the pod, and other size/shape parameters of the pod may be selected to fit different types of smoking devices. Therefore, a user may use the pod 105 for different smoking devices, thereby eliminating the need to use a separate utensil for different types of smoking devices.

Figure 7:
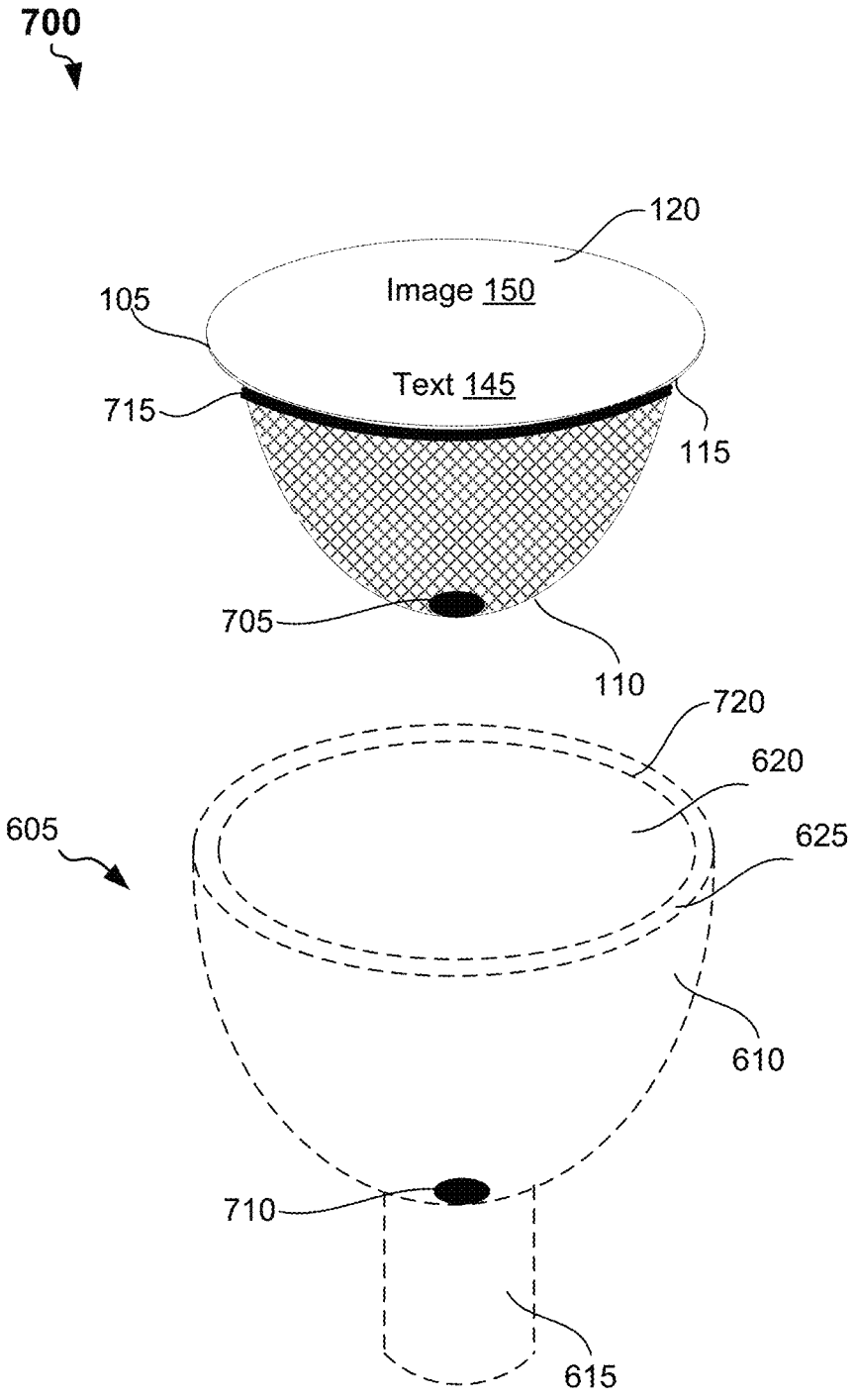
FIG. 7 is schematic diagram showing a pod configured for a lighter-free ignition of a product inside the pod, according to an example embodiment.

FIG. 7 is schematic diagram 700 showing a pod 105 configured for a lighter-free ignition of the product inside the pod 105, according to an example embodiment. The insert 110 of the pod 105 may have a pod conductor point 705. Similarly, the receptacle 605 may have a receptacle conductor point 710. Upon placing the pod 105 into the receptacle 605, the pod conductor point 705 may contact the receptacle conductor point 710. In an example embodiment, each of the pod conductor point 705 and the receptacle conductor point 710 may be made of metal. The pod conductor point 705 may be attached to the mesh of the insert 110. The receptacle conductor point 710 may be connected with a heating element (not shown) located inside the smoking pipe.

The user may activate the heating element of the smoking pipe, e.g., by pressing a button (not shown) that switches the heating element on/off. Upon activating the heating element, the heating element may heat the receptacle conductor point 710. As the receptacle conductor point 710 is in contact with the pod conductor point 705, the heating of the receptacle conductor point 710 causes heating of the pod conductor point 705. The product inside the pod contacts the pod conductor point 705 and the insert 110 that is connected to the pod conductor point 705 and may be heated along with heating of the pod conductor point 705. Heating of the pod conductor point 705 to a predetermined temperature may cause the ignition of the product inside the pod 105. Therefore, no lighter may be needed to ignite the product inside the pod 105.

In a further example embodiment, the pod 105 may have a stop 715. The stop 715 may include a ring made of a resilient material. The stop 715 may be placed onto a portion located close to an outer edge of the insert 110 and under the ring 115. The resilient material of the stop 715 may include rubber, silicone, plastic material, and so forth. The material of the stop 715 may include medical-grade or food-grade material. Upon placing the pod 105 into the receptacle 605, the stop 715 may contact an inner diameter 720 of the receptacle 605. Specifically, the stop 715 may be located between the mesh of the insert 110 and the inner diameter 720 of the receptacle 605. The stop 715 may be configured to engage the pod 105 with the receptacle 605 to prevent the pod 105 from falling out of the receptacle 605.

Figure 8A:
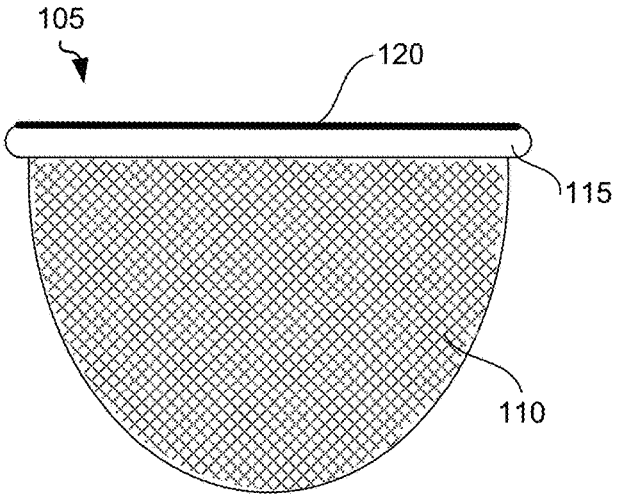
FIGS. 8A-8C are schematic diagrams showing various shapes of inserts of a pod, according to an example embodiment.
Figure 8B:
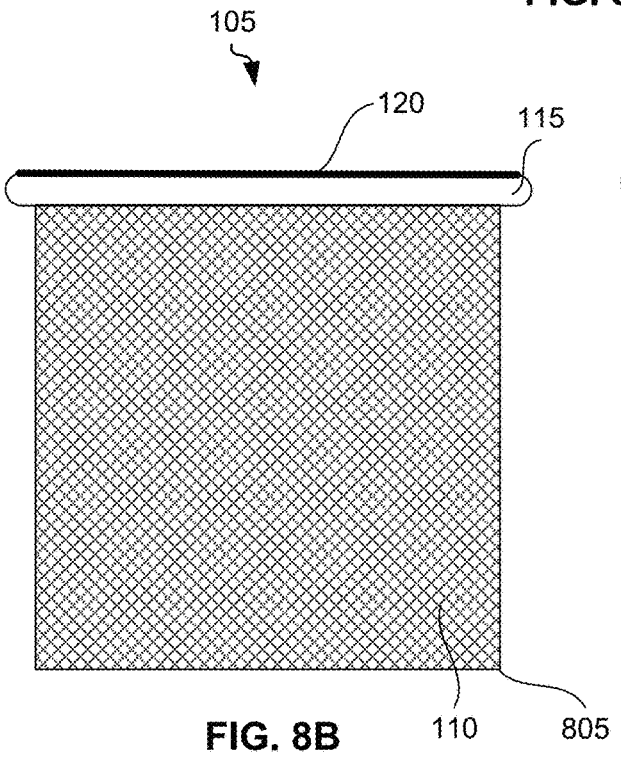
Figure 8C:
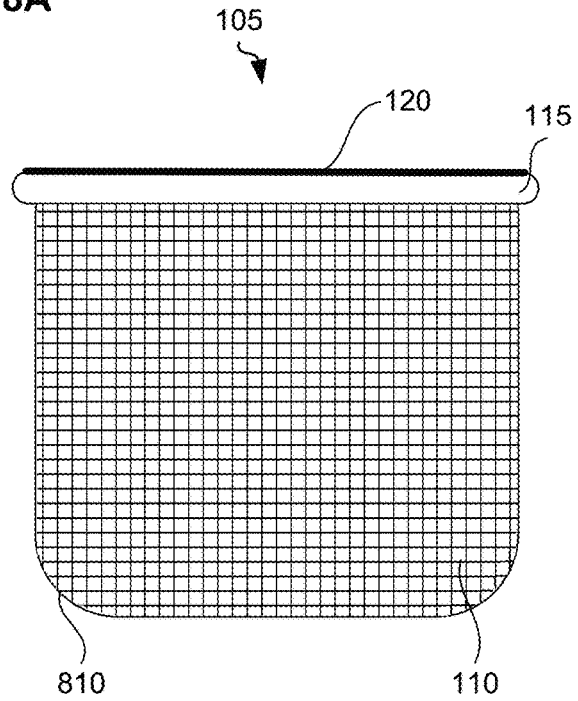

FIGS. 8A-8C are schematic diagrams showing shapes of an insert of a pod, according to an example embodiment. The insert 110 may have a convex three-dimensional shape. FIG. 8A shows a pod 105 with the insert 110 having a hemispheroid shape. FIGS. 8B and 8C show a pod 105 with the insert 110 having a rectangular three-dimensional shape. The insert 110 of the pod 105 shown in FIG. 8B has the rectangular three-dimensional shape with non-rounded angles 805. The insert 110 of the pod 105 shown in FIG. 8C has the rectangular three-dimensional shape with rounded angles 810. Other three-dimensional shapes of the insert may include a hemisphere, a conical three-dimensional shape, and any other shape to fit receptacles or pod acceptors in smoking pipes, vaporizing devices, and other smoking devices.

Figure 9:
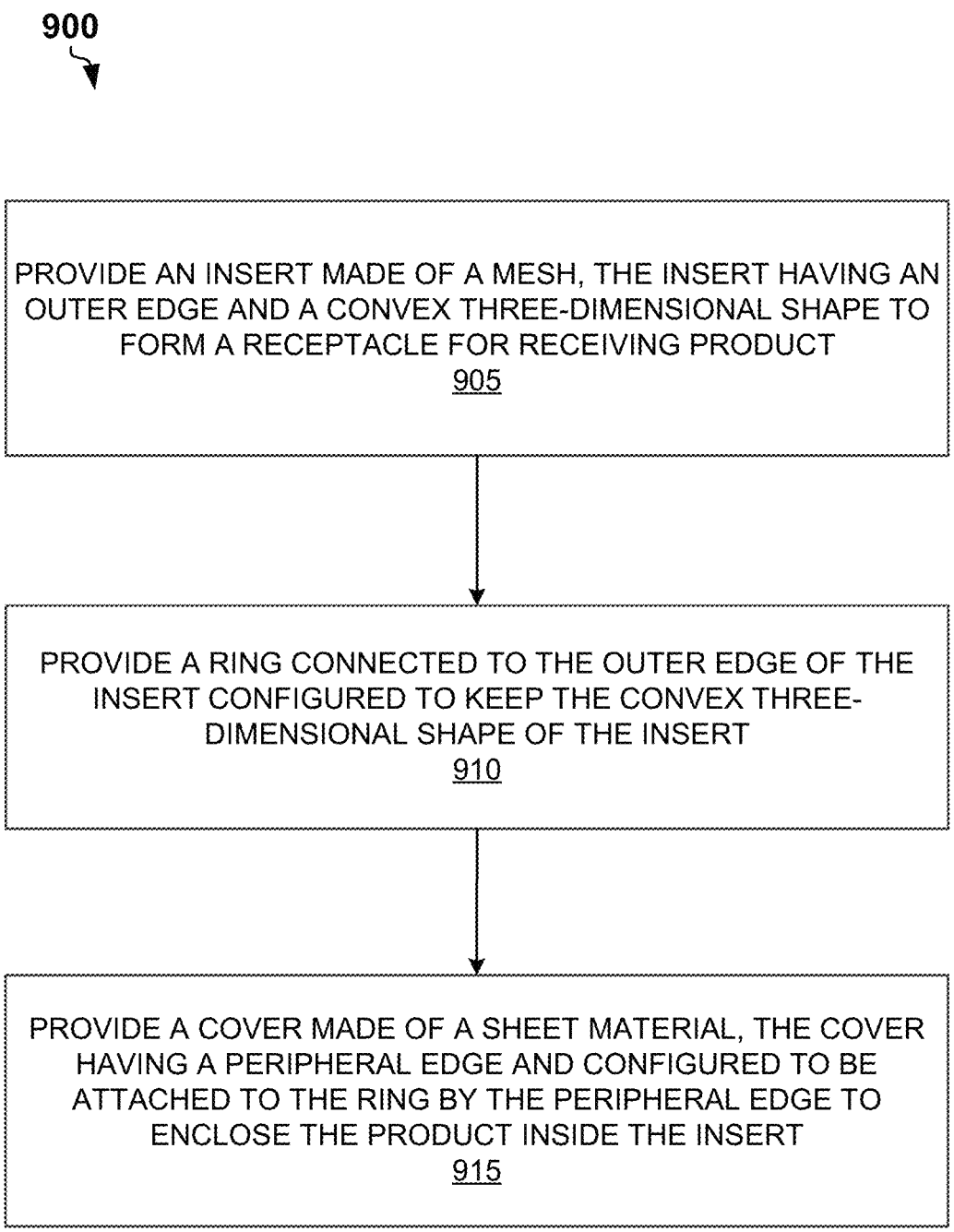
FIG. 9 is a flow chart showing a method for providing an individually packaged pod, according to an example embodiment.

FIG. 9 is a flow chart showing a method 900 for providing an individually packaged pod, according to an example embodiment. The method 900 may commence with providing an insert made of a mesh at step 905. The mesh may be made of one of the following: a plurality of wires woven with each other, plurality of wires soldered with each other, perforated metal sheet, and so forth. The insert may have a convex three-dimensional shape to form a receptacle for receiving a product. The insert may be press-formed to have the convex three-dimensional shape. The insert may have an outer edge.

The method 900 may further include providing a ring connected to the outer edge of the insert at step 910. The ring may be configured to maintain the convex three-dimensional shape of the insert. The ring may have an inner diameter and an outer diameter. The ring may further have a groove passing along the inner diameter. The outer edge of the insert may be pressed into the groove and retained inside the ring.

The method 900 may then continue with providing a cover made of a sheet material at step 915. The cover may have a peripheral edge and configured to be attached to the ring by the peripheral edge to enclose the product inside the insert. The ring may have a rim. The peripheral edge of the cover may be attached to the rim of the ring. The method 900 may further include providing the product and placing the product in the receptacle inside the insert. The product may include one or more of the following: a plant, marijuana, tobacco, an herb mixture, burnable substances, and so forth.

Figure 10:
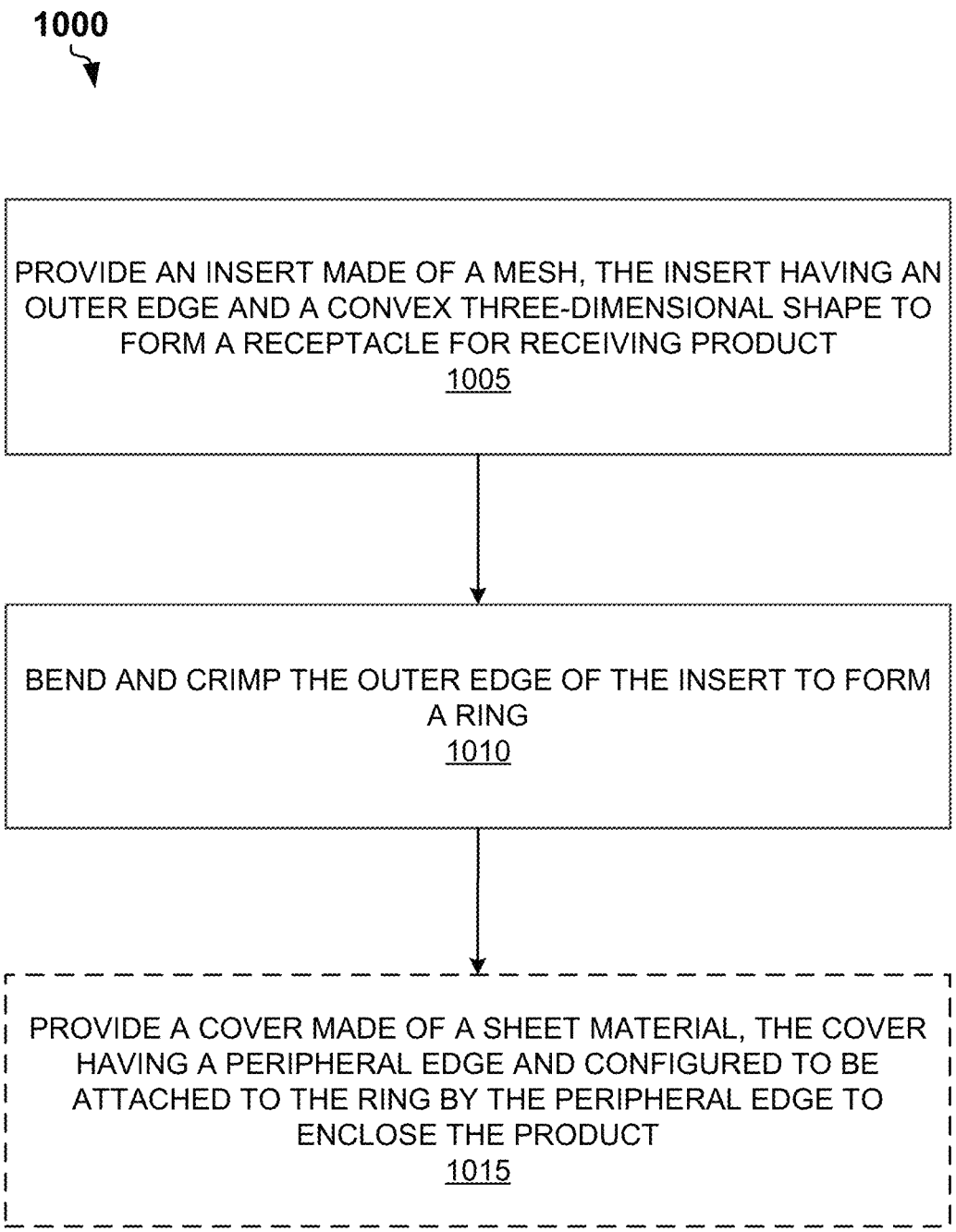
FIG. 10 is a flow chart showing a method for providing an individually packaged pod, according to an example embodiment.

FIG. 10 is a flow chart of a method 1000 for providing an individually packaged pod, according to an example embodiment. The method 1000 may commence with providing an insert made of a mesh at step 1005. The insert may include a convex three-dimensional shape to form a receptacle for receiving a product. The insert may be press-formed into the convex three-dimensional shape. The insert may have an outer edge. The method 1000 may also include bending and crimping the outer edge of the insert (i.e., the outer edge of the mesh) to form a ring along the outer edge at step 1010. The ring made by bending and crimping outer edge of the insert may maintain the convex three-dimensional shape of the insert.

The method 1000 may then proceed with providing a cover made of a sheet material at optional step 1015. The cover may have a peripheral edge and be attachable to the ring by the peripheral edge to enclose the product inside the insert. Optionally, the product may be provided and placed inside the insert before the cover is attached to the ring.

Thus, individually packaged pods and methods for providing individually packaged pods are described. Although embodiments have been described with reference to specific exemplary embodiments, it will be evident that various modifications and changes can be made to these exemplary embodiments without departing from the broader spirit and scope of the present application. Accordingly, the specification and drawings are to be regarded in an illustrative rather than a restrictive sense.

What is claimed is:

1. An individually packaged pod, comprising:

a ring including a sheet having an internal edge and an external edge, the sheet being bent to make a groove between the internal edge and the external edge;

an insert made of a mesh, the insert having an outer edge, the insert having a convex three-dimensional shape to form a receptacle for receiving a product, the outer edge of the insert being located in the groove between the internal edge and the external edge of the ring, a diameter of the outer edge of the insert being substantially equal to a diameter of the internal edge of the ring and less than a diameter of the external edge of the ring, the ring being configured to maintain the convex three-dimensional shape of the insert; and a cover made of a sheet material, the cover having a peripheral edge, the cover being configured to be attached to the ring by the peripheral edge and create, when attached, a flat surface extending over the ring and the insert in order to enclose the product inside the insert, wherein, when ignited, the cover burns through and causes ignition of the product in the receptacle.

2. The individually packaged pod of claim 1, further comprising the product placed in the receptacle inside the insert.

3. The individually packaged pod of claim 1, wherein the mesh is made of one of the following: a plurality of wires woven with each other, a plurality of wires soldered to each other, and a perforated metal sheet.

4. The individually packaged pod of claim 1, wherein the outer edge of the insert is pressed into the groove and retained inside the ring.

5. The individually packaged pod of claim 1, wherein the sheet material of the cover includes paper.

6. The individually packaged pod of claim 5, wherein the paper includes one or more of the following: rice paper, hemp paper, flax paper, sisal paper, and esparto paper.

7. The individually packaged pod of claim 1, wherein the insert is press-formed to be in the convex three-dimensional shape.

8. The individually packaged pod of claim 1, wherein the ring has a rim, the peripheral edge of the cover being attached to the rim.

9. The individually packaged pod of claim 1, wherein the convex three-dimensional shape is selected to fit a receptacle of a smoking pipe.

10. The individually packaged pod of claim 1, wherein the product includes one or more of the following: a medical product, a medical plant, a marijuana plant, a tobacco plant, a burnable substance, and a plant mixture.

11. The individually packaged pod of claim 1, wherein the ring is made of a metal.

12. The individually packaged pod of claim 1, wherein the cover is of a circular shape.

13. A method for providing an individually packaged pod, the method comprising:

providing a ring including a sheet having an internal edge and an external edge, the sheet being bent to make a groove between the internal edge and the external edge;

providing an insert made of a mesh, the insert having an outer edge, the insert having a convex three-dimensional shape to form a receptacle for receiving a product, the outer edge of the insert being located in the groove between the internal edge and the external edge of the ring, a diameter of the outer edge of the insert being substantially equal to a diameter of the internal edge of the ring and less than a diameter of the external edge of the ring, the ring being configured to maintain the convex three-dimensional shape of the insert; and providing a cover made of a sheet material, the cover having a peripheral edge, the cover being configured to be attached to the ring by the peripheral edge and create, when attached, a flat surface extending over the ring and the insert in order to enclose the product inside the insert, wherein, when ignited, the cover burns through and causes ignition of the product in the receptacle.

14. The method of claim 13, further comprising providing the product placed in the receptacle inside the insert.

15. The method of claim 13, wherein the mesh is made of one of the following: a plurality of wires woven with each other, a plurality of wires soldered to each other, and a perforated metal sheet.

16. The method of claim 13, wherein the outer edge of the insert is pressed into the groove and retained inside the ring.

17. The method of claim 13, wherein the insert is press-formed to have the convex three-dimensional shape.

18. The method of claim 13, wherein the ring has a rim, the peripheral edge of the cover being attached to the rim.

19. The method of claim 13, wherein the product includes one or more of the following: a plant, marijuana, tobacco, a burnable substance, and a plant mixture.

20. An individually packaged pod, comprising:

a ring including a sheet having an internal edge and an external edge, the sheet being bent to make a groove between the internal edge and the external edge;

an insert made of a mesh, the insert having an outer edge, the insert having a convex three-dimensional shape to form a receptacle for receiving a product, the outer edge of the insert being located in the groove between the internal edge and the external edge of the ring, a diameter of the outer edge of the insert being substantially equal to a diameter of the internal edge of the ring and less than a diameter of the external edge of the ring, the ring being configured to maintain the convex three-dimensional shape of the insert, wherein the insert is press-formed to have the convex three-dimensional shape and the outer edge of the insert is pressed into the groove and retained inside the ring;

a cover made of a sheet material, the cover having a peripheral edge, the cover being configured to be attached to the ring by the peripheral edge and create, when attached, a flat surface extending over the ring and the insert in order to enclose the product inside the insert, wherein, when ignited, the cover burns through and causes ignition of the product in the receptacle; and the product placed in the receptacle inside the insert.

* * * * *